US010763093B2

(12) United States Patent
Kou

(10) Patent No.: US 10,763,093 B2
(45) Date of Patent: Sep. 1, 2020

(54) MASS ANALYSIS APPARATUS AND MASS ANALYSIS METHOD

(71) Applicant: JEOL Ltd., Tokyo (JP)

(72) Inventor: Junkei Kou, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 16/296,673

(22) Filed: Mar. 8, 2019

(65) Prior Publication Data

US 2019/0287783 A1 Sep. 19, 2019

(30) Foreign Application Priority Data

Mar. 14, 2018 (JP) ..... 2018-046657

(51) Int. Cl.

| | |
|---|---|
| ***H01J 49/00*** | (2006.01) |
| ***H01J 49/22*** | (2006.01) |
| ***H01J 49/06*** | (2006.01) |
| *H01J 49/42* | (2006.01) |

(52) U.S. Cl.

CPC ..... *H01J 49/0031* (2013.01); *H01J 49/0045* (2013.01); *H01J 49/061* (2013.01); *H01J 49/22* (2013.01); *H01J 49/426* (2013.01)

(58) Field of Classification Search

CPC .. H01J 49/0045; H01J 49/0031; H01J 49/061; H01J 49/22; H01J 49/426

See application file for complete search history.

(56) References Cited

U.S. PATENT DOCUMENTS

| | | | | |
|---|---|---|---|---|
| 4,588,889 | A * | 5/1986 | Naito | H01J 49/32 250/282 |
| 5,073,713 | A * | 12/1991 | Smith | H01J 49/004 250/282 |
| 5,420,423 | A | 5/1995 | Linden | |
| 5,847,385 | A | 12/1998 | Dresch | |
| 6,525,314 | B1 * | 2/2003 | Jarrell | H01J 49/40 250/292 |
| 6,570,153 | B1 * | 5/2003 | Li | H01J 49/0081 250/282 |
| 6,781,117 | B1 | 8/2004 | Willoughby et al. | |

(Continued)

FOREIGN PATENT DOCUMENTS

| | | | |
|---|---|---|---|
| JP | 2004507875 | A | 3/2004 |
| JP | 2010127714 | A | 6/2010 |

(Continued)

OTHER PUBLICATIONS

Anonymous, Electrostatic Deflection, Wikipedia, Oct. 23, 2017, https://en.wikipedia.org/w/index.php?title=Electrostatic_deflection&oldid=806702646, retrieved on Jul. 22, 2019.

(Continued)

*Primary Examiner* — Wyatt A Stoffa

(74) *Attorney, Agent, or Firm* — The Webb Law Firm

(57) ABSTRACT

Neutral particles are blocked by a deflector provided upstream of a detector. A controller changes a reference potential V2 of the deflector in connection with a change of a reference potential V1 of a collision cell such that a potential difference ΔV between the reference potential V1 and the reference potential V2 is constant. The change of the reference potential V2 is executed during a period in which an ion pulse does not pass the deflector.

13 Claims, 6 Drawing Sheets

(56) References Cited

U.S. PATENT DOCUMENTS

| | | | | |
|---|---|---|---|---|
| 6,953,928 | B2 * | 10/2005 | Vestal | H01J 49/0418 250/281 |
| 7,615,742 | B2 * | 11/2009 | Brekenfeld | H01J 49/424 250/281 |
| 7,633,059 | B2 * | 12/2009 | Russ, IV | H01J 49/0027 250/281 |
| 7,932,487 | B2 * | 4/2011 | Kovtoun | H01J 49/062 250/281 |
| 9,105,456 | B2 * | 8/2015 | Jiang | H01J 49/004 |
| 9,236,235 | B2 * | 1/2016 | Muntean | H01J 49/063 |
| 9,773,656 | B2 * | 9/2017 | Nishiguchi | H01J 49/22 |
| 2002/0117616 | A1 * | 8/2002 | Vestal | H01J 49/004 250/287 |
| 2004/0056189 | A1 | 3/2004 | Tanner et al. | |
| 2006/0138318 | A1 * | 6/2006 | Enke | H01J 49/40 250/287 |
| 2009/0218486 | A1 | 9/2009 | Whitehouse et al. | |
| 2011/0174967 | A1 * | 7/2011 | Kou | H01J 49/427 250/287 |
| 2011/0291003 | A1 | 12/2011 | Kou | |
| 2012/0160998 | A1 | 6/2012 | Kou | |
| 2015/0187555 | A1 * | 7/2015 | Hirano | H01J 49/061 250/288 |
| 2017/0148620 | A1 * | 5/2017 | Nishiguchi | H01J 49/422 |
| 2018/0366313 | A1 | 12/2018 | Hoyes et al. | |

FOREIGN PATENT DOCUMENTS

| | | | |
|---|---|---|---|
| JP | 2010531031 | A | 9/2010 |
| JP | 2011249069 | A | 12/2011 |
| JP | 2012138270 | A | 7/2012 |
| JP | 2013254668 | A | 12/2013 |
| WO | 2017087470 | A1 | 5/2017 |

OTHER PUBLICATIONS

Extended European search report issued in EP19161648.1 dated Jul. 29, 2019.

* cited by examiner

ΔV (const.)

| COMPOUND | Q1 (m/z) | q2:V1 (V) | Q3 (m/z) | V2 (V) |
|---|---|---|---|---|
| A | 1000 | −20 | 500 | −100 |
| B | 800 | −10 | 200 | −90 |
| C | 600 | −15 | 100 | −95 |
| ⋮ | ⋮ | ⋮ | ⋮ | ⋮ |

FIG. 4

MASS ANALYSIS APPARATUS AND MASS ANALYSIS METHOD

CROSS-REFERENCE TO RELATED APPLICATION

This application claims priority to Japanese Patent Application No. 2018-046657 filed Mar. 14, 2018, the disclosure of which is hereby incorporated by reference in its entirety.

BACKGROUND OF THE INVENTION

Field of the Invention

The present disclosure relates to a mass analysis apparatus and a mass analysis method, and in particular to a mass analysis apparatus having a collision cell and a mass analysis method which uses the mass analysis apparatus.

Description of Related Art

Various apparatuses are commercialized as mass analysis apparatuses. Among these apparatuses, a triple quadrupole mass analysis apparatus generally comprises an ion source, a first mass analyzer, a collision cell, a second mass analyzer, and a detector.

Specific examples of these elements will now be described. The first mass analyzer is an element which selects precursor ions having a particular mass-to-charge ratio (m/z) from among ions generated by the ion source. The first mass analyzer is formed as a first quadrupole apparatus. The collision cell is an element in which the precursor ions are caused to collide with a collision-induced dissociation gas (CID gas) to cause cleavage or dissociation of the precursor ions, and to thereby generate product ions (which are also called "fragment ions") from the precursor ions. The collision cell is formed as a second quadrupole apparatus having a quadrupole ion guide. The second mass analyzer is an element which selects particular product ions as target ions from among the product ions generated in the collision cell. The second mass analyzer is formed as a third quadrupole apparatus. The detector is formed from an electron multiplier. In some cases, a conversion dynode may be placed near the electron multiplier.

In mass analysis apparatuses disclosed in JP 2010-127714 A, JP 2011-249069 A, and JP 2012-138270 A, the collision cell periodically executes a storing operation and an ejecting operation, in order to improve sensitivity. Alternatively, the collision cell may be formed by a collision chamber other than that described above.

SUMMARY OF THE INVENTION

In the ion source of the mass analysis apparatus, ions are generated by giving energy to molecules forming a sample. During this process, neutral particles which are in an excited state may also be generated. The neutral particles are electrically neutral particles which were set in the excited state by receiving the energy, but which were not formed into ions. The neutral particles may also be called neutral excited particles. In the collision cells also, the neutral particles may be generated along with the ions.

The neutral particles move straight in the mass analysis apparatus without being affected by an electric field or a magnetic field. For example, when the neutral particles ionize gas particles existing near the detector and ions are thus generated, the generated ions would be detected by the detector. In particular, when the conversion dynode is provided, the ions derived from the neutral particles also tend to be more easily detected, and thus, the above-described problem becomes significant. Moreover, the neutral particles themselves may be ionized, which may then cause noise.

As a countermeasure to the above-described problem, a deflector which blocks the neutral particles may be provided upstream of the detector. However, when such a deflector is operated regardless of operation conditions of the collision cell, it becomes possible that the target ions cannot be properly extracted at the deflector. JP 2013-254668 A discloses formation of an electric field so that the problem of the neutral particles do not occur significantly. JP 2004-507875 A and JP 2010-531031 A disclose structures that block the neutral particles.

An advantage of the present disclosure lies in allowing appropriate detection of target ions while blocking the neutral particles even when the operation conditions of the collision cell change in the mass analysis apparatus.

According to one aspect of the present disclosure, there is provided a mass analysis apparatus comprising: a collision cell that generates product ions from precursor ions; a detector that detects target ions selected from among the product ions; a deflector that is provided between the collision cell and the detector and that applies a deflection action on the target ions; and a controller that changes a reference potential of the deflector in connection with a change of a reference potential of the collision cell.

In the above-described structure, for example, the reference potential of the collision cell is changed according to, for example, the precursor ions, compounds that caused the precursor ions, or other conditions. If the reference potential of the deflector is fixed even when the reference potential of the collision cell is changed, kinetic energy of the target ions entering the deflector would change, and the deflection action of the deflector cannot be maintained. In consideration of this, the controller changes the reference potential of the deflector in connection with the change of the reference potential of the collision cell so that the deflection action of the deflector is maintained or is made appropriate. In an embodiment of the present disclosure, the reference potential of the deflector is controlled in such a manner that a difference between the reference potential of the collision cell and the reference potential of the deflector is a constant value. According to this control, the kinetic energy of the target ions entering the deflector becomes constant, and thus, the target ions are always appropriately deflected in the deflector. According to an embodiment of the present disclosure, because it becomes possible to appropriately detect the target ions after appropriately separating or blocking the neutral particles by the deflector, an SN ratio can be improved.

According to another aspect of the present disclosure, the reference potential of the collision cell is an ion trajectory potential in the collision cell, and the reference potential of the deflector is an ion trajectory potential in the deflector or an entrance electrode potential in the deflector. For example, the collision cell is formed as a quadrupole-type apparatus. The apparatus has four poles (electrodes) which are placed in parallel to each other, and a center line surrounded thereby is an ion trajectory. A potential at the ion trajectory is the reference potential of the collision cell. The reference potential corresponds to an offset potential. The reference potential of the deflector is determined according to the type of the deflector. For example, in a case of a parallel plate type deflector which does not have an entrance electrode, a potential at an intermediate position between two electrodes is the reference potential. In a case of a parallel plate type deflector which has an entrance electrode, a potential of the entrance electrode is the reference potential.

According to another aspect of the present disclosure, the controller changes the reference potential of the deflector in connection with the change of the reference potential of the collision cell such that a deflection angle of the target ions in the deflector is constant regardless of the change of the reference potential of the collision cell. According to another aspect of the present disclosure, the controller changes the reference potential of the deflector in connection with the change of the reference potential of the collision cell such that a potential difference between the reference potential of the collision cell and the reference potential of the deflector is constant.

According to another aspect of the present disclosure, the collision cell repeatedly executes an ion storing operation and an ion ejecting operation, the target ions pass the deflector as an ion pulse, and the controller changes the reference potential of the deflector in a period other than a period in which the deflection action by an electric field is applied to the target ions in the deflector. According to this structure, because the reference potential of the deflector is changed in a period in which the deflector is not operating, it is possible to avoid influences of the change of the reference potential on the target ions.

According to another aspect of the present disclosure, the mass analysis apparatus further comprises an ion source that ionizes a sample; a first mass analyzer that selects the precursor ions from among ions generated by the ion source; and a second mass analyzer that selects the target ions from among the product ions generated in the collision cell, wherein the deflector is provided between the second mass analyzer and the detector. In the second mass analyzer, normally, product ions having a particular m/z are selected as the target ions, but alternatively, a part or all of product ions having a plurality of m/z's may be selected as the target ions.

According to another aspect of the present disclosure, there is provided a mass analysis method comprising: generating product ions from precursor ions in a collision cell; detecting target ions selected from among the product ions in a detector; applying a deflection action on the target ions in a deflector provided between the collision cell and the detector; and changing a reference potential of the deflector in connection with a change of a reference potential of the collision cell.

BRIEF DESCRIPTION OF THE DRAWINGS

Embodiment(s) of the present disclosure will be described by reference to the following figures, wherein:

FIG. 4 is a diagram showing an operation condition:

DESCRIPTION OF THE INVENTION

An embodiment of the present disclosure will now be described with reference to the drawings.

Figure 1:
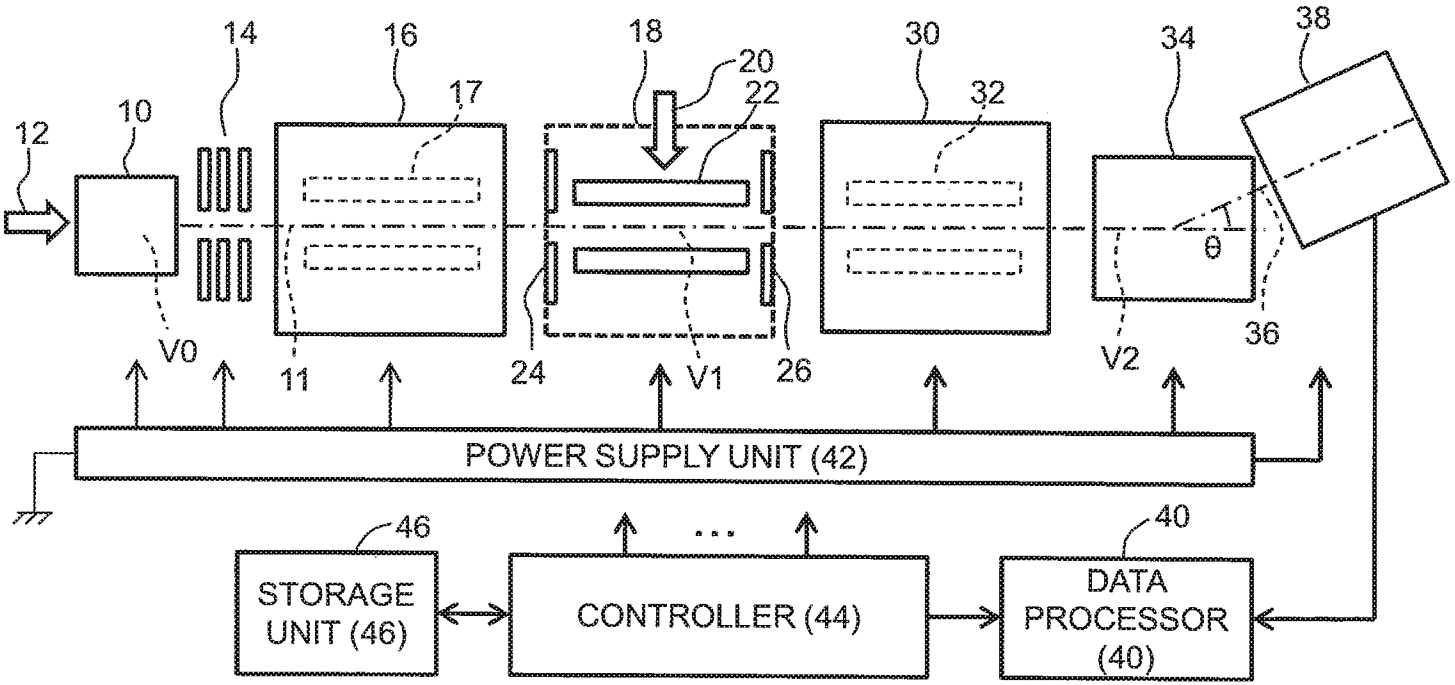
FIG. 1 is a block diagram showing a mass analysis apparatus according to an embodiment of the present disclosure.

FIG. 1 shows a mass analysis apparatus according to an embodiment of the present disclosure. The mass analysis apparatus is a storing type, triple quadrupole mass analysis apparatus. For example, a plurality of compounds which are timewise separated by a sample introduction apparatus such as a gas chromatograph are sequentially introduced into the mass analysis apparatus (refer to reference numeral 12).

An ion source 10 is a device which ionizes the introduced compound. As a method of ionization, electronic ionization (EI), chemical ionization (CI), matrix-assisted laser desorption/ionization (MALDI), electrospray ionization (ESI), and the like are known. A reference potential of the ion source is shown as V0. The reference potential of the ion source 10 is, for example, an intermediate potential or a center potential in a chamber of the ion source 10. A lens 14 having an aperture electrode or the like is provided downstream of the ion source 10. In FIG. 1, reference numeral 11 shows an ion trajectory.

A first mass analyzer 16 is a device which selects, using a difference in a mass-to-charge ratio, first target ions to be sent to a collision cell 18 from among precursor ions (parent ions) derived from the compounds and generated by the ion source. In the embodiment, the first mass analyzer 16 is a quadrupole-type mass analyzer having four poles (electrodes) 17. In a quadrupole-type device, high-frequency signals having the same amplitude and the same frequency are applied to the poles to satisfy a predetermined condition. The predetermined condition is a condition that high-frequency signals of the same phase are applied to two poles in a diagonal relationship, and high-frequency signals of opposite phases are applied to two adjacent poles. In addition to the high-frequency signal, a direct current signal and an offset signal are applied to each pole. A sign of the direct current signal is determined according to the above-described predetermined condition. The offset signal is common to four high-frequency signals. For example, m/z to be selected is changed by changing a level of the direct current signal. The offset signal determines an offset potential. Alternatively, as the first mass analyzer 16, a mass analyzer of another type having an ion selection function may be provided. The collision cell 18 is provided downstream of the first mass analyzer 16.

The collision cell 18 is a device which causes the precursor ions which are the first target ions to collide with a collision gas 20 introduced from an outside, to cause cleavage or dissociation of the precursor ions, and to consequently generate fragment ions. As the collision gas, for example, helium gas, nitrogen gas, argon gas, or the like is used. In the embodiment, the collision cell is a quadrupole-type device having an ion guide 22 made of four poles (electrodes).

The collision cell 18 of the embodiment alternately and repeatedly executes a storing operation and an ejecting operation. In the storing period, ions are stored in the collision cell 18, and in the ejecting period which follows the storing period, the stored ions are output to the downstream device as an ion pulse. The collision cell 18 has an entrance electrode 24 and an exit electrode 26, and the storing operation and the ejecting operation are switched by a control of potentials of the entrance electrode 24 and the exit electrode 26. Specifically, for the exit electrode 26, a voltage pulse is periodically applied. When the potential of the exit electrode 26 becomes larger than the potential (reference potential V0) of the ion source 10, the exit electrode 26 is set to a closed state. When the potential of the exit electrode 26 becomes lower than an axial potential (reference potential V1) of the ion guide 22, the exit electrode 26 is set to an open state.

Alternatively, a voltage pulse may be periodically applied to the entrance electrode 24. By setting the entrance electrode 24 in the closed state during the ion ejecting period, entrance of non-target ions into the collision cell can be prevented. During the ion storing period, the entrance electrode 24 is set to an open state. When a potential of the entrance electrode 24 becomes higher than the potential of the ion source 10, the entrance electrode 24 is set to the closed state. When the potential of the entrance electrode 24 becomes lower than the potential of the ion source 10, the entrance electrode 24 is set to the open state.

The reference potential V1 is a potential on a center line surrounded by the four poles; that is, the ion trajectory, and is the offset potential. In the embodiment, the reference potential V1; that is, the offset potential, is switched according to the compound or the first target ion (precursor ion to be selected). For example, a controller 44 refers to a table stored in a storage unit 46, specifies the offset potential corresponding to the compound or the first target ion, and controls a power supply unit 42 such that the specified offset potential is actually applied to the collision cell 18. The table is, for example, a table for managing a relationship between a plurality of compounds (or first target ions) and a plurality of offset potentials. When the offset potential is changed, a velocity of the first target ions changes, and an impact force at the time of collision changes. A second mass analyzer 30 is provided downstream of the collision cell 18.

Similar to the first mass analyzer 16, the second mass analyzer 30 is a device which selects, using the difference of the mass-to-charge ratio, second target ions which are detection targets, from among product ions having various m/z's and generated in the collision cell 18. In the embodiment, the second mass analyzer 30 is formed from a quadrupole-type mass analyzer having four poles (electrodes) 32. Alternatively, as the second mass analyzer 30, a mass analyzer of another type having an ion selection function may be provided. A deflector 34 is provided downstream of the second mass analyzer 30.

The deflector 34 is a device which separates or blocks neutral particles and extracts the second target ions. As will be described later with reference to FIG. 2, the deflector 34 is a parallel plate deflector, and deflects the second target ions with an electric field. A deflection angle is shown by θ in FIG. 1. The neutral particles move straight regardless of the electric field, and are deviated from an ion trajectory 36 directed to a detector. Alternatively, as the deflector 34, a deflector other than the parallel plate deflector may be employed.

A reference potential of the deflector 34 is shown by V2. The reference potential is a potential at an intermediate level between two parallel plates, and is a potential on the ion trajectory. In the case of the parallel plate deflector having the entrance electrode, the reference potential is set to the same potential as the potential of the entrance electrode. In the embodiment, the controller 44 controls the power supply unit 42 to change the reference potential V2 of the deflector 34 in connection with a change of the reference potential V1 of the collision cell 18. More specifically, the reference potential V2 is adaptively set so that a potential difference ΔV between the reference potential V1 and the reference potential V2 is constant. With this control, the kinetic energy of the second target ions entering the deflector 34 becomes constant regardless of the reference potential V1 of the collision cell 18. With this configuration, the deflection action in the deflector 34 can be maintained constant.

An alternative configuration may be considered in which, according to the change of the kinetic energy of the second target ions, a strength of the electric field is adaptively changed, to maintain the deflection angle θ. As compared to such an alternative configuration, the control can be simplified according to the embodiment. A detector 38 is provided downstream of the deflector 34.

In the embodiment, the detector 38 has a conversion dynode and an electron multiplier. With collision of the second target ions onto the conversion dynode, electrons are generated. The electrons are detected and multiplied by the electron multiplier. With this process, a detection signal is generated. Because the neutral particles are blocked by the deflector 34, the neutral particles do not reach a region near the detector 38 or inside thereof, and thus, generation of background ions due to the neutral particles is prevented or significantly reduced. With this configuration, the S/N ratio can be improved. Alternatively, a structure other than that described above may be employed as the detector 38.

A data processor 40 is a module which comprises electric circuits such as an amplifier and an A/D converter, and a processor, and which processes detected data. The controller 44 controls operations of various elements shown in FIG. 1, and comprises a CPU and an operation program. In the storage unit 46, the above-described table is stored, and a necessary program is stored. As described above, the controller 44 manages and controls the reference potential (offset potential) V1 and the reference potential V2 through control of the power supply unit 42. The data processor 40, the controller 44, and the storage unit 46 may be formed by a PC. Alternatively, the controller 44 may be formed from a plurality of processors. Alternatively, the controller 44 may be formed from another control device which operates according to a program.

In the structure shown in FIG. 1, the deflector 34 may be provided at another position; for example, a position between the collision cell 18 and the second mass analyzer 30. However, in consideration of various neutral particles generated in the collision cell 18 or in elements downstream thereof, the deflector 34 is desirably placed immediately before the detector 38.

In the above description, an operation mode is described for executing the precursor ion selection and the product ion selection. The mass analysis apparatus according to the embodiment may operate in another operation mode. In the embodiment, the collision cell periodically repeats the storing operation and the ejecting operation, but alternatively, the deflector may be provided in a mass analysis apparatus having a collision cell which does not execute such a periodical operation. In this case also, the reference potentials are set such that the potential difference between the reference potential of the collision cell and the reference potential of the deflector is always constant.

Figure 2:
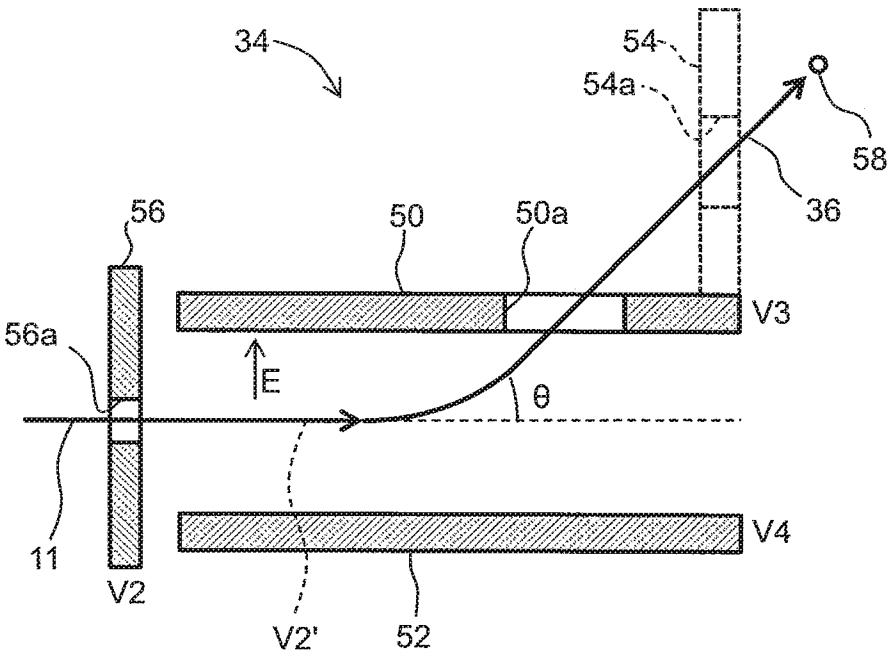
FIG. 2 is a schematic diagram showing a first configuration of a deflector.

FIG. 2 shows a specific example configuration (first configuration) of the deflector 34 shown in FIG. 1. The deflector 34 comprises a flat plate-shaped electrode 50 and a flat plate-shaped electrode 52 which are in a parallel relationship with each other. An electric field E is generated between the electrodes 50 and 52. With the electric field E, a deflection action is applied to the second target ions. Specifically, deflection is caused from the ion trajectory 11 to an ion trajectory 36. The deflection angle is θ. In FIG. 2, positive ions 58 are shown as the second target ions.

The electrode 50 has an opening 50*a* for allowing the second target ions to pass. A shape of the opening 50*a* is, for example, a quadrangle. In the deflector 34 shown in the drawing, an electrode 54 which is in an orthogonal relationship with the electrode 50 is provided as necessary. The potentials of the electrodes 54 and 50 are the same. Alternatively, the electrode 50 and the electrode 54 may be integrated, to form an L shape electrode. The electrode 54 has an opening 54*a* for allowing the second target ions to pass. A shape of the opening 54*a* is, for example, a quadrangle. In addition, the deflector 34 shown in the drawing has an entrance electrode 56. The entrance electrode 56 has a flat plate shape, and an opening 56*a* is formed at a center part thereof. A shape of the opening 56*a* is, for example, a circle. The second target ions enter the deflector 34 through the opening 56*a*.

In the deflector 34 shown in the drawing, the potential of the entrance electrode 56 is the reference potential V2. A distance between two electrodes 50 and 52 is, for example, a few cm. A potential of the electrode 50 is V3, and a potential of the electrode 52 is V4. For example, when the reference potential V1 of the collision cell is a certain potential, V2 is −100V, V3 is −130V, and V4 is −70V. In this case, a potential V2' at an intermediate point (intermediate level) of the two electrodes 50 and 52 is −100V. In a structure in which the entrance electrode 56 is not provided, the potential V2' is the reference potential of the deflector 34. The reference potential V2 is set according to the reference potential V1. Specifically, V2, V3, and V4 are changed such that a difference ΔV between V1 and V2 is constant.

Figure 3:
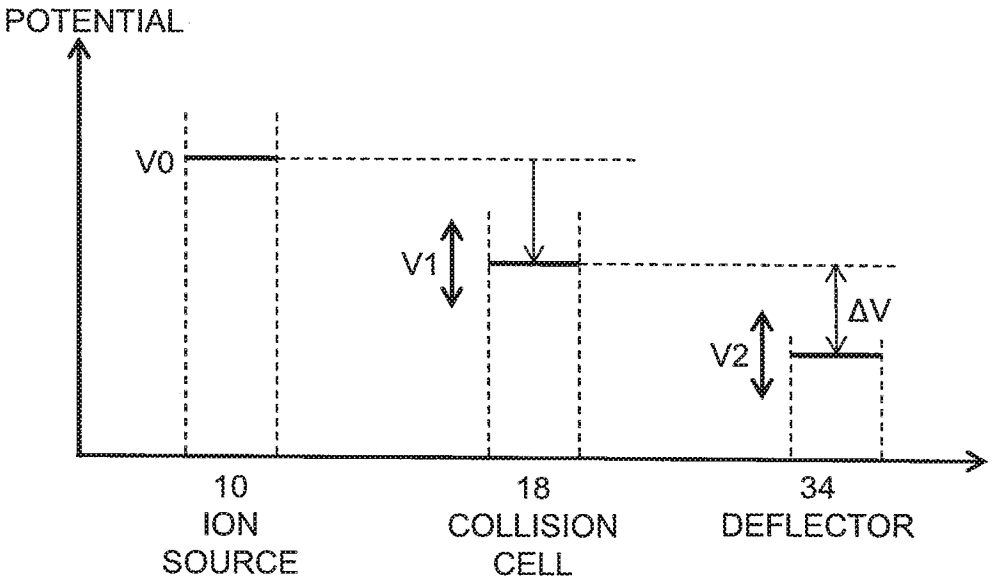
FIG. 3 is a diagram showing a relationship of potentials.

FIG. 3 shows a potential relationship. Specifically, FIG. 3 shows the reference potential V0 of the ion source 10, the reference potential V1 of the collision cell 18, and the reference potential V2 of the deflector 34. The reference potential V1 is changed according to the compound or the selected precursor ion. With this change, the reference potential V2 is adaptively changed such that the difference ΔV between the reference potential V1 and the reference potential V2 is always constant. The difference ΔV is a potential energy consumed by the ions, and corresponds to the kinetic energy. Thus, setting the difference ΔV constant corresponds to setting kinetic energy of the ions constant. When the kinetic energy of the ions is constant, the deflection angle θ is also constant.

FIG. 4 shows an operation condition. In the example configuration shown in the drawing, precursor ions having a particular m/z are selected at the first mass analyzer (Q1), and product ions having a particular m/z are selected at the second mass analyzer (Q3). According to the compound, the reference potential (offset potential) V1 of the collision cell (q2) is changed. With this change, the reference potential V2 of the deflector is changed such that the potential difference ΔV is constant. In the example configuration shown in the drawing, ΔV is −80V. It should be noted that the numerical values described in the present disclosure are merely exemplary, and may be suitably altered.

Figure 5:
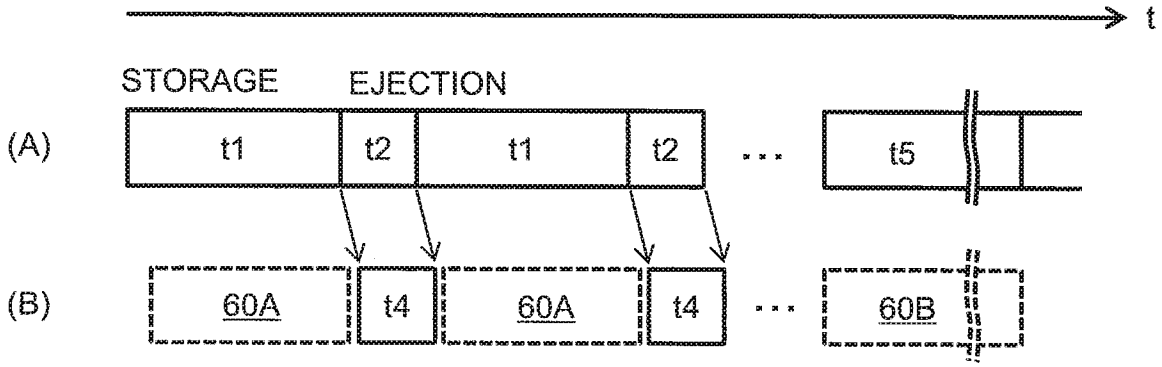
FIG. 5 is a timing chart showing operations of a collision cell and a deflector.

In FIG. 5, (A) shows an operation of the collision cell, and (B) shows a time when the ion pulse passes the deflector. In the collision cell, a storing period t1 and an ejecting period t2 are repeatedly set. In each ejecting period t2, the ion pulse is generated, and passes the deflector at a passing period t4. Reference numeral 60A shows an idle time when the ion pulse does not pass. A period t5 in the collision cell is a non-operation period in which the change of the offset voltage or the like is executed. In the deflector, a period corresponding to the non-operation period is a period 60B. The change of the reference potential V2 of the deflector is executed in a period in which the ion pulse is not passing the deflector. For example, the change is executed in the period 60B. Alternatively, the change may be executed in the period 60A. A time required for the change of the reference potential is generally 0.1 ms or shorter.

Figure 6:
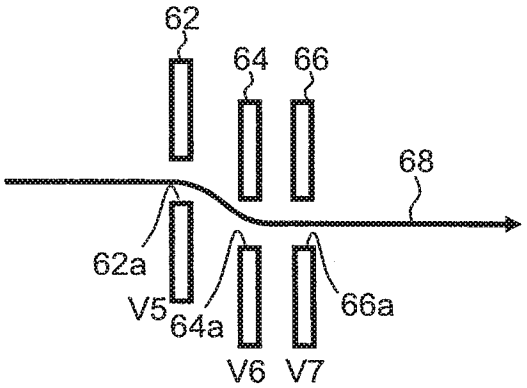
FIG. 6 is a diagram showing a second configuration of the deflector.

FIG. 6 shows a second configuration of the deflector. The deflector shown in the drawing comprises an off-axis type electrostatic lens. The deflector comprises three flat-plate electrodes 62, 64, and 66 which are placed in parallel to each other, and openings 62*a*, 64*a*, and 66*a* for allowing the second target ions to pass are respectively formed thereon. Not all of the three openings 62*a*, 64*a*, and 66*a* are aligned on a straight line, and, in the example configuration shown in the drawing, the opening 62*a* is deviated in the horizontal direction with respect to the other openings 64*a* and 66*a*. Potentials of the three electrodes 62, 64, and 66 are shown by V5, V6, and V7. In the example configuration shown in the drawing, the reference potential is V5. According to an increase or a decrease of the potential of the collision cell, the three potentials V5, V6, and V7 are increased or decreased. Reference numeral 68 shows an ion trajectory.

Figure 7:
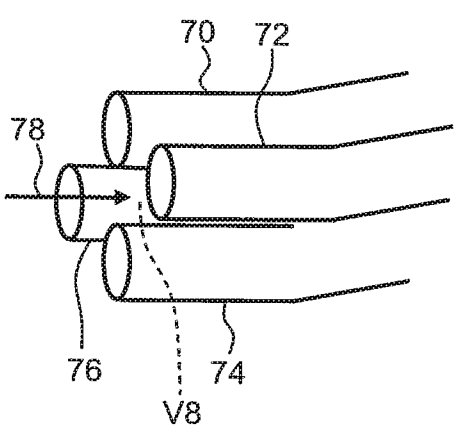
FIG. 7 is a diagram showing a third configuration of the deflector.

FIG. 7 shows a third configuration of the deflector. The deflector shown in the drawing comprises a bent-type ion guide, and comprises four poles 70~76 which are bent. Target ions 78 travel on the center line surrounded by the four poles. A potential V8 on the center line is the reference potential, which is also the offset potential.

Figure 8:
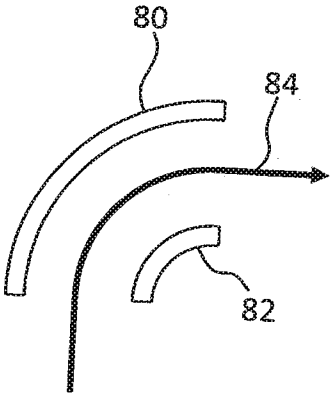
FIG. 8 is a diagram showing a fourth configuration of the deflector.

FIG. 8 shows a fourth configuration of the deflector. The deflector shown in the drawing is a curved electrostatic deflector, and comprises a flat-shaped outer electrode 80 which is curved and a flat-shaped inner electrode 82 which is curved. Reference numeral 84 shows an ion trajectory. A potential on the ion trajectory is the reference potential.

According to the embodiment described above, the neutral particles can be separated and blocked by the deflector. In this case, because the reference potential of the deflector is changed in connection with the change of the reference potential of the collision cell, the kinetic energy of the ions entering the deflector can be set constant, and the deflection action of the deflector is maintained. In addition, because the reference potential of the deflector is changed during a period in which the deflector is not acting, influence of the change of the reference potential on the target ions can be avoided.

The invention claimed is:

1. A mass analysis apparatus comprising:

a collision cell that generates product ions from precursor ions;

a detector that detects target ions selected from among the product ions;

a deflector that is provided between the collision cell and the detector and that applies a deflection action on the target ions; and a controller that changes a reference potential of the deflector in connection with a change of a reference potential of the collision cell such that a potential difference between the reference potential of the collision cell and the reference potential of the deflector is constant.

2. The mass analysis apparatus according to claim 1, wherein the reference potential of the collision cell is an ion trajectory potential in the collision cell, and the reference potential of the deflector is an ion trajectory potential in the deflector or an entrance electrode potential in the deflector.

3. The mass analysis apparatus according to claim 1, wherein the controller changes the reference potential of the deflector in connection with the change of the reference potential of the collision cell such that a deflection angle of the target ions in the deflector is constant regardless of the change of the reference potential of the collision cell.

4. The mass analysis apparatus according to claim 1, wherein the collision cell repeatedly executes an ion storing operation and an ion ejecting operation, the target ions passes the deflector as an ion pulse, and the controller changes the reference potential of the deflector in a period other than a period in which the deflection action by an electric field is applied to the target ions in the deflector.

5. The mass analysis apparatus according to claim 1, wherein the controller changes the reference potential of the collision cell according to the precursor ions or compounds from which the precursor ions are originated.

6. The mass analysis apparatus according to claim 1, further comprising:

an ion source that ionizes a sample;

a first mass analyzer that selects the precursor ions from among ions generated by the ion source; and a second mass analyzer that selects the target ions from among the product ions generated in the collision cell, wherein the deflector is provided between the second mass analyzer and the detector.

7. A mass analysis method comprising:

generating product ions from precursor ions in a collision cell;

detecting target ions selected from among the product ions in a detector;

applying a deflection action on the target ions in a deflector provided between the collision cell and the detector; and changing a reference potential of the deflector in connection with a change of a reference potential of the collision cell such that a potential difference between the reference potential of the collision cell and the reference potential of the deflector is constant.

8. A mass analysis apparatus comprising:

an ion source that generates ions;

a collision cell that generates product ions from precursor ions selected from among the ions generated by the ion source;

a detector that detects target ions selected from among the product ions;

a deflector that is provided between the collision cell and the detector and that applies a deflection action on the target ions, wherein the deflector and the detector are positioned to a side of the collision cell opposite the ion source; and a controller that changes a reference potential of the deflector in connection with a change of a reference potential of the collision cell, wherein the controller changes the reference potential of the deflector in connection with the change of the reference potential of the collision cell such that a deflection angle of the target ions in the deflector is constant regardless of the change of the reference potential of the collision cell.

9. The mass analysis apparatus according to claim 8, wherein the reference potential of the collision cell is an ion trajectory potential in the collision cell, and the reference potential of the deflector is an ion trajectory potential in the deflector or an entrance electrode potential in the deflector.

10. The mass analysis apparatus according to claim 8, wherein the controller changes the reference potential of the deflector in connection with the change of the reference potential of the collision cell such that a potential difference between the reference potential of the collision cell and the reference potential of the deflector is constant.

11. The mass analysis apparatus according to claim 8, wherein the collision cell repeatedly executes an ion storing operation and an ion ejecting operation, the target ions passes the deflector as an ion pulse, and the controller changes the reference potential of the deflector in a period other than a period in which the deflection action by an electric field is applied to the target ions in the deflector.

12. The mass analysis apparatus according to claim 8, wherein the controller changes the reference potential of the collision cell according to the precursor ions or compounds from which the precursor ions are originated.

13. The mass analysis apparatus according to claim 8, further comprising:

a first mass analyzer that selects the precursor ions from among the ions generated by the ion source; and a second mass analyzer that selects the target ions from among the product ions generated in the collision cell, wherein the deflector is provided between the second mass analyzer and the detector.

* * * * *